United States Patent [19]

Eaton et al.

[11] 3,967,149

[45] June 29, 1976

[54] SPARK PLUG

[75] Inventors: Carl J. Eaton, Toledo; Richard S. Podiak, Maumee, both of Ohio

[73] Assignee: Champion Spark Plug Company, Toledo, Ohio

[22] Filed: Nov. 6, 1974

[21] Appl. No.: 521,182

Related U.S. Application Data

[62] Division of Ser. No. 376,524, July 5, 1973, Pat. No. 3,868,530.

[52] U.S. Cl. ..... 313/141; 29/25.12

[51] Int. Cl.[2] ..... H01T 13/20

[58] Field of Search ..... 29/25.12, 25.17, 25.18, 29/510, 511, 517; 313/136, 141

[56] References Cited

UNITED STATES PATENTS

| | | | |
|---|---|---|---|
| 2,013,411 | 9/1935 | Hummel | 29/25.17 |
| 2,257,566 | 9/1941 | Lewis | 29/511 |
| 2,296,033 | 9/1942 | Heller | 313/141 |
| 2,691,915 | 10/1954 | Cherry | 29/511 |
| 2,910,983 | 11/1959 | Everett | 29/510 |
| 3,146,370 | 8/1964 | Duyne et al. | 313/136 |
| 3,407,326 | 10/1968 | Romine | 29/25.17 |

FOREIGN PATENTS OR APPLICATIONS

| | | | |
|---|---|---|---|
| 819,156 | 10/1937 | France | 313/141 |

*Primary Examiner*—Gerald A. Dost
*Assistant Examiner*—James W. Davie
*Attorney, Agent, or Firm*—Allen Owen

[57] ABSTRACT

This invention relates to spark plugs for internal combustion engines and is particularly directed to a center electrode having a sparking tip composed of a precious metal and to the method of making the same. The known advantage of the use of a precious metal electrode is that considerably greater spark plug life is achieved. The invention achieves the advantage while greatly reducing the mass of precious metal employed. A further feature of the invention is the co-planar disposition of the end of the center electrode and its supporting insulator.

3 Claims, 7 Drawing Figures

SPARK PLUG

This is a division of application Ser. No. 376,524 filed July 5, 1973, now U.S. Pat. No. 3,868,530.

BACKGROUND OF THE INVENTION

It is known in the art to use precious or semiprecious metals as electrode tips in spark plugs for prolonged life. For example, in the patent to Heller 2,296,033 the precious metal tip is welded to a body of much less expensive metal forming the center electrode and itself acts as the firing tip. This is true in a number of earlier designs. It has also been proposed to use tungsten or a tungsten alloy in such a construction as, for example, in the patent to Hensel 2,391,455. However, tungsten and tungsten alloys corrode rapidly in some modern internal combustion engines and any construction in which the sides of the tungsten tip are not protected show very low electrode life in certain services.

It is also known in the art, by the patent to Hensel 2,391,456, that the end of an electrode may be capped with a sheath of platinum or the like to form a long-wearing electrode where the core of the electrode is composed of molybdenum or a molybdenum alloy having high heat conductivity and a coefficient of thermal expansion substantially the same as that of the cap or sheath. The most common constructions have been to use a rivet of platinum seated in the bore of the insulator tip or into the bore of a split nickel sleeve as in the patent to Bretsch 3,256,457. The rivet is held in place by casting silver metal around the upper portion of the rivet head.

In practice the rivet construction requires a large amount of precious metal which contributes nothing useful to the sparking life of the electrode. A very large portion of the precious metal is wasted as a support rod. Also in practice it has been found difficult to attach the rivet securely for long periods of operation in the corrosive atmosphere of the combustion chamber.

In all of the prior art constructions the quantity of precious metal used is so high that, under modern conditions the price of the spark plug becomes excessive and the limited recourses of the precious metals are largely wasted.

In known spark plugs, the center electrode protrudes from its supporting insulator and deposits on the insulator surface are deliberately excluded from the firing process. It has been found that under some circumstances these deposits can actually be used in a beneficial manner to extend the life of the spark plug.

BRIEF DESCRIPTION OF THE INVENTION

The preferred form of the invention is an electrode comprising a base metal tube or drilled rod, such as a nickel alloy tube or a bored nickel alloy rod into the bore of which is inserted a short section of fine wire of a precious metal such as platinum or a platinum alloy. However, in place of platinum various other precious or semi-precious metals may be used including tungsten which is much less expensive. In this construction, the fine wire section utilized can be as low as 10% of that required by current known constructions to achieve comparable electrode life.

The fine section of precious metal wire having been inserted in the bore of the nickel tube, the tube is then swaged to reduce its diameter somewhat and to effectively lock the fine wire in place mechanically. The assembled electrode is then put into a supporting insulator and in the preferred form of the invention, positioned with the sparking surface flush with the insulator tip. However, the electrode may project beyond the insulator tip if desired.

In a second execution of the invention, the nickel electrode is outwardly flared and an end cavity is drilled or pierced to receive a small cylindrical section of precious metal wire. The nickel is then swaged back into its original diameter. This action firmly locks the precious metal insert into the base metal electrode by causing an undercut diameter in the precious metal wire at the position of entrance into the end of the base metal electrode. The swaging forces the trapped portion of the precious metal into full and firm engaging relationship with the electrode metal. This method of execution is effective for all precious and semi-precious metal insert alloys having ductility and malleability characteristics better than or equal to the base metal electrode.

DETAILED DESCRIPTION OF A PREFERRED EMBODIMENT

Figure 1:
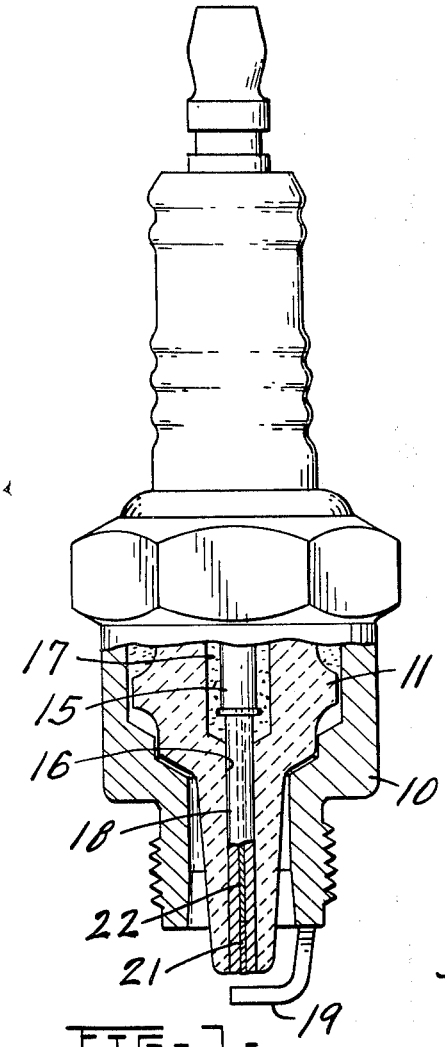
FIG. 1 is an elevational view with a portion shown as a central, vertical section of a spark plug having a center electrode formed according to the present invention.

FIG. 1 of the drawings shows a substantially conventional spark plug having a shell 10 that is adapted to be received in the threaded opening in an engine cylinder head. The plug comprises an insulator 11 seated in the shell 10, the insulator having a bore which receives a center electrode 15. The center electrode is positioned in a bore 16 of the insulator 11 and sealed against gas leakage by a tamped mass of powder 17 or by any other suitable means. The center electrode 15 includes a lower section 18 which may be made tubular or which may be drilled out to provide a central longitudinal hole for the purpose hereinafter described. A ground electrode 19 completes the spark plug. It will be noted that in the form of the invention shown in FIG. 1, the end of the lower section or firing end of the center electrode 18 is co-planar or flush with the flat end of the insulator 11.

Figure 2:
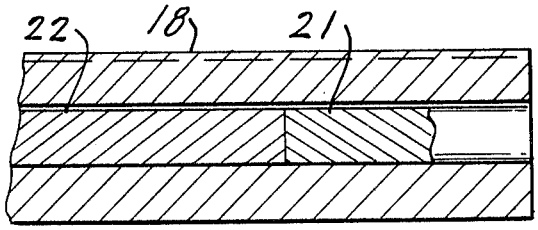
FIGS. 2 and 3 are fragmentary sectional views of the center electrode itself, somewhat enlarged to indicate the method of manufacture.
Figure 3:
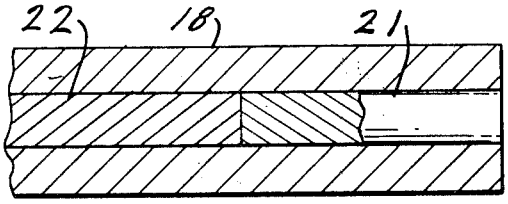

As indicated in FIG. 2 the lower electrode section 18, having been made tubular or having been drilled out, receives a fine wire insert which is, in the form shown made in two sections. One section of the fine wire insert is made from a precious metal and is designated 21. The remaining section of the wire insert is designated 22 and is made of a base metal such as iron or nickel merely to fill the bore of the nickel tube 18. In the preferred form the fine wire insert may range in diameter between 0.010 inch to approximately 0.030 inch and its length is between 0.150 inch and 0.250 inch. Above the larger diameter the construction ceases to show all of the economies desired. Below the finer diameter the small section of precious metal wire becomes very difficult to handle in assembling the electrode and the finer wires are therefore not preferred. Alloys of gold, platinum, palladium, rhodium, rhenium, ruthenium and tungsten are among the so-called precious metals that may be used for the exposed section of the fine wire electrode. Substantially the only criterion is that the precious metal alloy be such that it can be drawn into wire form and that it will resist sparking erosion.

After the fine wire section of precious metal 21 and the fine wire base metal section 22 are inserted into the bore of the nickel tube, which thereafter acts as a sheath for the fine wire insert, the assemblage is swaged to reduce the diameter of the lower electrode section somewhat and to lock the sections 21 and 22 in place in the sheath by mechanical adherence between the wire and the nickel sheath. It has been found that the swaged electrode stays together through repeated heating and cooling cycles because of the long axial contact between the insert and the nickel sheath. The apparatus used to accomplish the swaging step is conventional.

Figure 4:
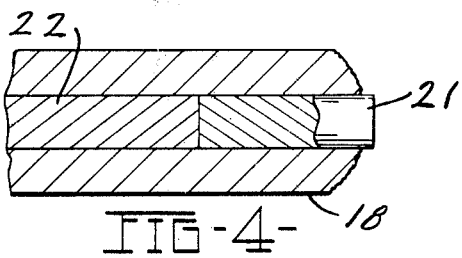
FIG. 4 is a central sectional view of an electrode showing a typical condition after operation for an extended period and in which the precious metal wire has become exposed by reason of erosion of the nickel sheath.

Sparking between the ground electrode 19 and the center electrode 18 takes place initially across the entire surface of the center electrode, since the sparking will occur to the point of least sparking voltage requirement. The nickel sheath, being somewhat less resistant to erosion, wears away leaving a small protruding tip of the precious metal wire exposed as indicated in FIG. 4. This Figure, then, diagrammatically represents the condition of the center electrode after several thousand miles of operation of the spark plug. It will be noted that the nickel sheath has eroded away but that the precious metal wire is still in its original condition and in operative relation to the ground electrode and the spark plug will still be capable of firing at a low sparking voltage. During operation of an engine on even lightly leaded fuels, conductive deposits form on the end of the insulator. By making this surface co-planar with the end of the electrode these conductive deposits participate in the sparking process and actually act as a center electrode to which sparks of an intensity sufficient to fire the cylinder charge can occur. This prolongs further the life of the spark plug of the present invention.

While experimental evidence indicates that a fine hole can be drilled axially into a rod of nickel to form the lower center electrode section 18, in practice the use of a nickel tube will be much more practical.

The base metal section 22 of the fine wire insert is used only to plug the bore of the tube 18 and conserve on the quantity of precious metal wire. The base metal plug will also produce a uniform outside diameter of the electrode during swaging and will assist in plugging the tube against gas leakage.

When the insert metal used is tungsten or a tungsten alloy wire, which is relatively inexpensive as compared to platinum or platinum alloy, the nickel sheath serves to protect the sides of the tungsten wire against chemical attack by the combustion gases. Tungsten alloys are found to be highly satisfactory materials for electrode use if the non-sparking surfaces can be adequately protected. The tightly swaged nickel sheath serves to protect the tungsten insert and confines the erosion and corrosion only to the exposed end face.

Figure 5:
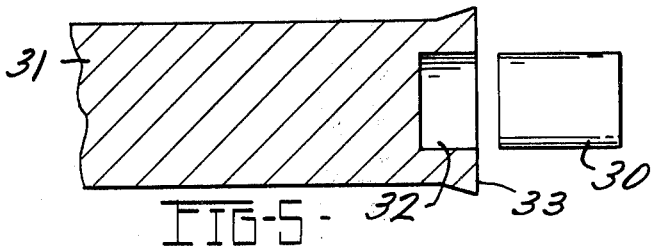
FIGS. 5 and 6 are fragmentary central sectional views showing a modification of the invention in which a small cylindrical pellet of precious metal is used.
Figure 6:
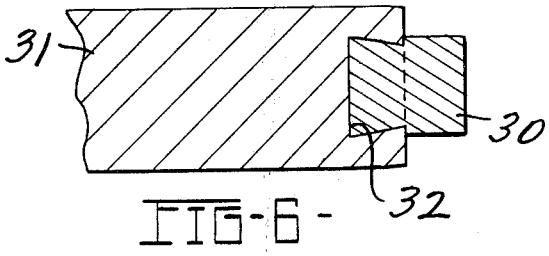

In the form of the invention shown in FIGS. 5 and 6 the precious metal is initially in the form of a small cylindrical pellet 30. The nickel electrode is shown at 31. The electrode is pierced at its firing end to form a recess 32 and the adjacent metal of the electrode is flared out as at 33. The pellet 30 is placed in the recess 32 and the assembly is swaged to force the nickel into intimate engagement with the side walls of the pellet as shown in FIG. 6. The swaging action causes the enlarged portion 33 of electrode 31 to exert greater radial pressure on the mid portion of the precious metal pellet 30 resulting in an undercut diameter in the pellet 30 at the point where it emerges from the nickel electrode 31. This action traps the portion of the insert 30 which is within the cavity 32 and forces it into full and tight contact with the walls of the cavity.

In production it may be found that handling the very small pellets 30 is impractical, in which case the pellet 30 will be formed after the swaging step and the process becomes one in which the end of a long wire will be inserted in the recess 32, the assembly swaged and the pellet then severed from the wire.

Figure 7:
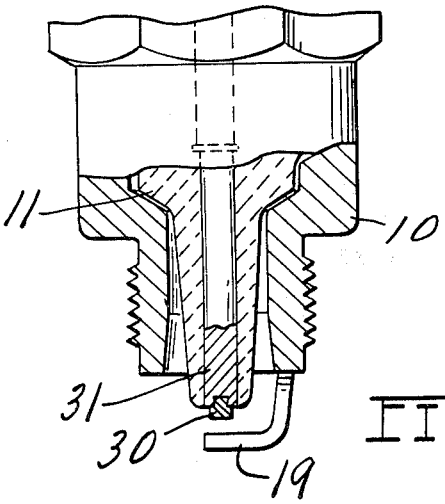
FIG. 7 is a fragmentary view, with parts in section, of a spark plug having a modified electrode form corresponding to FIG. 6.

During swaging, the precious metal of the pellet can be left extended from the nickel wire 31, if desired, as shown in FIG. 7. With this construction the sparking will occur generally only to the precious metal because the nickel will be too far away for sparking and the configuration of the tip of the plug will not change significantly after prolonged use. In this form also, however, the protrusion of the precious metal from the nickel may be omitted if desired.

What we claim is:

1. The method of manufacturing a spark plug center electrode which comprises flaring the end of a cylindrical wire of non-precious metal, forming a recess in said flared end, inserting a small body of precious metal into said recess, and swaging the parts together to return said flared end to a cylindrical configuration whereby the non-precious metal bites into and undercuts the side walls of said insert intermediate the ends of the insert.

2. The method of manufacturing a spark plug center electrode which comprises forming an axial hole in a wire of non-precious metal and of uniform diameter, filling at least a portion of said hole with an insert of precious metal wire, and swaging the wire parts together to uniformly reduce the diameter of said non-precious metal wire and grip said precious metal wire insert mechanically at its side walls only.

3. The article of manufacture produced by the method of claim 2.

* * * * *